United States Patent [19]

Takahashi et al.

[11] Patent Number: 4,929,535

[45] Date of Patent: May 29, 1990

[54] HIGH CONTRAST NEGATIVE IMAGE-FORMING PROCESS

[75] Inventors: Toshiro Takahashi; Kimitaka Kameoka; Yoshio Inagaki, all of Kanagawa, Japan

[73] Assignee: Fuji Photo Film Co., Ltd., Kanagawa, Japan

[21] Appl. No.: 214,892

[22] Filed: Jun. 30, 1988

Related U.S. Application Data

[63] Continuation of Ser. No. 907,770, filed as PCT JP86/00021 on Jan 21, 1986, abandoned.

[30] Foreign Application Priority Data

Jan. 22, 1985 [JP] Japan ..... 60-9347

[51] Int. Cl.[5] ..... G03C 1/06; G03C 5/24

[52] U.S. Cl. ..... 430/264; 430/265; 430/268; 430/448; 430/487; 430/601; 430/949

[58] Field of Search ..... 430/264, 265, 268, 448, 430/487, 601, 949, 357, 375

[56] References Cited

U.S. PATENT DOCUMENTS

| | | | |
|---|---|---|---|
| 3,523,023 | 8/1970 | Lowe et al. | 430/601 |
| 3,706,562 | 12/1972 | Herz et al. | 430/487 |
| 4,247,620 | 1/1981 | Nagatani et al. | 430/601 |
| 4,329,417 | 5/1982 | Nagatani et al. | 430/601 |
| 4,569,904 | 2/1986 | Okutsu et al. | 430/268 |
| 4,699,873 | 10/1987 | Takahashi et al. | 430/446 |

*Primary Examiner*—Richard L. Schilling
*Assistant Examiner*—Hoa Van Le
*Attorney, Agent, or Firm*—Sughrue, Mion, Zinn, Macpeak & Seas

[57] ABSTRACT

This invention is a process of quickly forming high contrast negative images, which are useful for photomechanical process, by development-processing a silver halide photographic material containing a hydrazine derivative in at least one of silver halide emulsion layer(s) and other hydrophilic colloid layer(s) after imagewise exposure in the existence of a compound represented by general formula (A);

(A)

wherein $R_1$, $R_2$ and $R_3$ each represents an alkyl group, a cycloalkyl group, an aryl group, an alkenyl group, a cycloalkenyl group, or a heterocyclic ring residue, these groups may have a substituent; m represents an integer; L represents an m-valent organic group bonded to the P atom through a carbon atom; n represents an integer of 1 to 3; and X represents an n-valent anion; said X may be bonded to L; using a stable processing solution. Furthermore, the invention is a high contrast negative type silver halide photographic material containing the compound of the above-described general formula (A) in at least one of the silver halide emulsion layer(s) and other hydrophilic colloid layer(s) thereof.

6 Claims, No Drawings

HIGH CONTRAST NEGATIVE IMAGE-FORMING PROCESS

This is a continuation of application Ser. No. 907,770, filed as PCT JP86/00021 on Jan. 21, 1986, now abandoned.

TECHNICAL FIELD

This invention relates to a high contrast negative image-forming process and a high contrast negative type silver halide photographic materials and, more particularly, to a process of quickly forming high contrast negative images useful for photomechanical process using a stable processing solution.

BACKGROUND ART

In a photomechanical process, it is necessary to obtain high contrast (in particular, 10 or higher than 10 in gamma) characteristics for improving the reproduction of continuous tone images by dot images or the reproduction of line images. Hitherto, for the above-described purpose, a process of using a combination of a light-sensitive material composed of a silver chloride emulsion or a silver chlorobromide emulsion having a high content of silver chloride and a hydroquinone developer (infectious developer) having a very low effective concentration of sulfite ion (usually not more than 0.1 mol/liter) is generally used. However, in the process of using an infectious developer, there is a problem that the developer is very unstable due to the low sulfite ion concentration in the developer and cannot be stably stored over 3 days.

As an improved process for attaining high contrast photographic characteristics using a stable developer, there is a process of using a specific hydrazine compound described in U.S. Pat. No. 4,224,401, etc. According to this process, the existence of a high concentration of sulfite ion in the developer is possible, whereby the developer is protected from aerial oxidation to improve the stability.

Also, in U.S. Pat. No. 4,269,929, it is proposed to add an amine compound to a developer for further improving the above-described high contrast image-forming process using the hydrazine compound and obtaining negative images having high gamma value with a developer having a lower pH value.

DISCLOSURE OF INVENTION

However, even in the case of using the above-described image-forming process, high contrast images are hard to be obtained for so-called rapid access process (i.e., a very quick photographic process usually requiring 90 seconds to 120 seconds for the total processing time from the initiation of development process to the obtainment of processed film through development, fix, washing, and drying, wherein the time for the development is 15 seconds to 60 seconds), which has been highly needed recently.

An object of this invention is, therefore, to provide an image-forming process capable of obtaining high contrast negative image of over 10 in gamma using a stable developer by quick photographic processing.

It has now been discovered that the above-described object of this invention is attained by developing a silver halide photographic material having on a support at least one silver halide emulsion layer, said emulsion layer or other hydrophilic colloid layer containing a hydrazine derivative in the existence of the compound represented by the following general formula (A) after imagewise exposure:

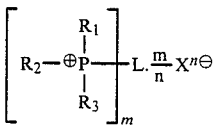

(A)

wherein $R_1$, $R_2$ and $R_3$ each represents an alkyl group, a cycloalkyl group, an aryl group, an alkenyl group, a cycloalkenyl group, or a heterocyclic residue, these groups each may further have a substituent; m represents an integer; L represents an m-valent organic group bonded to the P atom through a carbon atom; n represents an integer of 1 to 3; and X represents an n-valent anion; said X may be bonded to L.

Then, the compound represented by general formula (A) described above is explained in detail.

In general formula (A), $R_1$, $R_2$ and $R_3$ may be the same or different. Specific examples of the groups represented by $R_1$, $R_2$ and $R_3$ are a straight chain or branched alkyl group such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group, an octadecyl group, etc.; a cycloalkyl group such as a cyclopropyl group, a cyclopentyl group, a cyclohexyl group, etc.; an aryl group such as a phenyl group, a naphthyl group, a phenanthryl group, etc.; an alkenyl group such as an allyl group, a vinyl group, a 5-hexenyl group, etc.; a cycloalkenyl group such as a cyclopentenyl group, a cyclohexenyl group, etc.; and a heterocyclic residue such as a pyridyl group, a quinolyl group, a furyl group, an imidazolyl group, a thiazolyl group, a thiadiazolyl group, a benzotriazolyl group, a benzothiazolyl group, a morpholinyl group, a pyrimidinyl group, a pyrrolidinyl group, etc. These groups represented by $R_1$, $R_2$ and $R_3$ may have a substituent and examples cf such a substituent are a halogen atom such as a fluorine atom, a chlorine atom, a bromine atom, an iodine atom, etc., a nitro group, a primary, secondary or tertiary amino group, an alkyl ether group, an aryl ether group, an alkyl thioether group, an aryl thioether group, a carbonamido group, a carbamoyl group, a sulfonamido group, a sulfamoyl group, a hydroxyl group, a sulfoxy group, a sulfonyl group, a carboxy group, a sulfonic acid group, a cyano group, and a carbonyl group, etc., in addition to the above-described groups represented by $R_1$, $R_2$ and $R_3$.

Specific examples of the groups represented by L are a polymethylene group such as a trimethylene group, a tetramethylene group, a hexamethylene group, a pentamethylene group, an octamethylene group, a dodecamethylene group, etc., a divalent aromatic group such as a phenylene group, a biphenylene group, a naphthylene group, etc., a polyvalent aliphatic group such as a trimethylenemethyl group, a tetramethylenemethyl group, etc., and a polyvalent aromatic group such as a phenylene-1,3,5-toluyl group, a phenylene-1,2,4,5-tetrayl group, etc., in addition to the above-described groups represented by $R_1$, $R_2$ and $R_3$.

The total carbon atom number of each of the groups represented by $R_1$, $R_2$ and $R_3$ is preferably 30 or less than 30, more preferably 20 or less than 20.

Also, it is preferred that at least one of the groups represented by $R_1$, $R_2$ and $R_3$ is an alkyl group which may be substituted or an aryl group which may be substituted.

Examples of the anion represented by X are a halogen ion such as a chloride ion, a bromide ion, an iodide ion, etc., a carboxylate ion such as an acetate ion, an oxalate ion, a fumarate ion, a benzoate ion, etc., a sulfonate ion such as a p-toluenesulfonate ion, a methanesulfonate ion, a butanesulfonate ion, a benzenesulfonate ion, etc., a sulfate ion, a perchloride ion, a carbonate ion, a nitrate ion, etc.

In general formula (A) above, m is preferably 1 to 3, particularly preferably 1 or 2.

In the particularly preferred compound represented by general formula (A) described above, m is 1 or 2; when m is 1, L represents the group having at most 20 carbon atoms in the groups represented by $R_1$, $R_2$ and $R_3$ and when m is 2, L represents a divalent organic group having at most 20 carbon atoms bonded to the P atom by a carbon atom, n represents 1 or 2, and X represents a divalent anion, said X may be bonded to L.

Many of the compounds represented by general formula (A) described above are known compounds and some of these compounds are commercially available as reagents. As general processes for producing these compounds, there are a process of reacting a phosphinic acid and an alkylating agent such as a halogenated alkyl, a sulfonic acid ester, etc., and a process of exchanging a counter anion of phosphonium salts by an ordinary method.

Then, specific examples of the compounds represented by general formula (A) are illustrated below but the invention is not limited to these compounds.

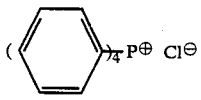
(A-1)

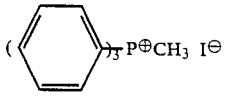
(A-2)

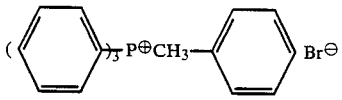
(A-3)

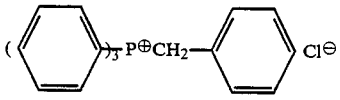
(A-4)

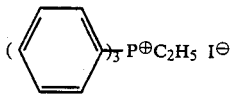
(A-5)

$(n\text{-}C_4H_9)_4P^{\oplus}\ Br^{\ominus}$ (A-6)

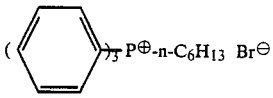
(A-7)

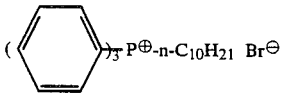
(A-8)

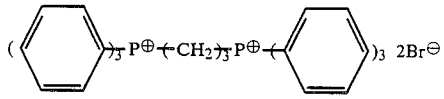
(A-9)

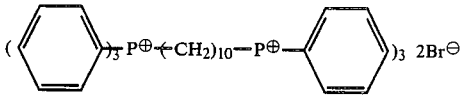
(A-10)

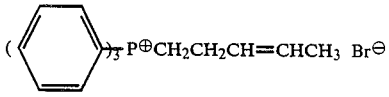
(A-11)

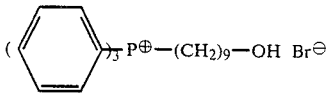
(A-12)

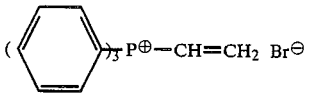
(A-13)

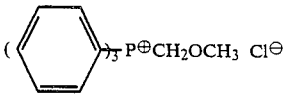
(A-14)

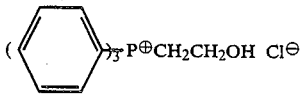
(A-15)

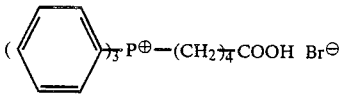
(A-16)

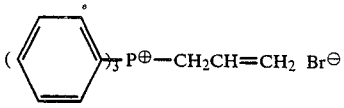
(A-17)

$(n\text{-}C_4H_9)_3P^{\oplus}\text{-}n\text{-}C_{16}H_{33}\ Br^{\ominus}$ (A-18)

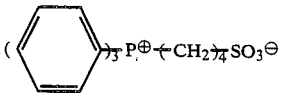
(A-19)

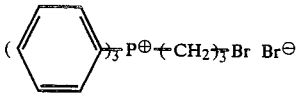
(A-20)

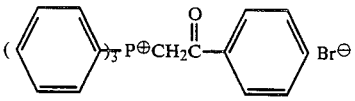
(A-21)

-continued

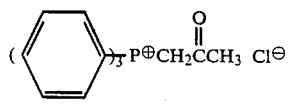

(A-22)

$(n\text{-}C_4H_9)_3P^{\oplus}CH_2CH_2OH\ Br^{\ominus}$ (A-23)

$(n\text{-}C_4H_9)_3P^{\oplus}C_2H_5.\frac{1}{2}.SO_4^{2\ominus}$ (A-24)

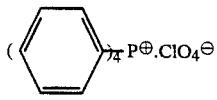

(A-25)

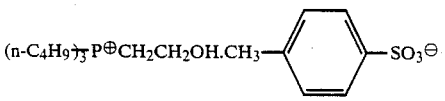

(A-26)

$(n\text{-}C_4H_9)_3P^{\oplus}CH_3\ I^{\ominus}$ (A-27)

$(HOCH_2)_3P^{\oplus}CH_3\ I^{\ominus}$ (A-28)

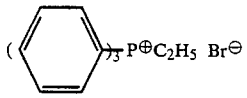

(A-29)

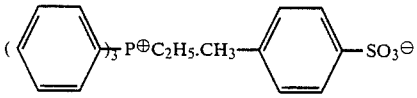

(A-30)

In this invention, the compound of general formula (A) may exists in a developer or the processing solution for prebath thereof or may exist in at least one of the silver halide emulsion layer(s) and other hydrophilic colloid layer(s) (e.g., a protective layer, interlayer(s), etc.) of a photographic light-sensitive material but it is preferred that the compound exist in a photographic light-sensitive material. In this case, the compound of general formula (A) may exist in the same layer containing a hydrazine derivative or in other layer than the layer containing a hydrazine derivative.

In the case of adding the compound of general formula (A) to a processing solution such as developer, it is preferred that the content of the compound is $10^{-5}$ mol to $10^{-2}$ mol per liter of the processing solution. Also, in the case of adding the compound to a coated layer of a photographic light-sensitive material, it is preferred that the content of the compound is $1\times10^{-6}$ to $1\times10^{-1}$ mol, in particular $1\times10^{-5}$ mol to $5\times10^{-2}$ mol, per mol of the silver halide in the silver halide emulsion layer of the light-sensitive material.

The compound of the present invention represented by general formula (A) described above is incorporated in a photographic light-sensitive material in the following manner. That is, when the compound is water-soluble, the compound may be added to a silver halide emulsion solution or a hydrophilic colloidal solution as an aqueous solution thereof and when the compound is insoluble in water, the compound may be added to a silver halide emulsion solution or a hydrophilic colloidal solution as a solution thereof in an organic solvent miscible with water, such as an alcohol (e.g., methanol, ethanol, etc.), an ester (e.g., ethyl acetate, etc.), a ketone (e.g., acetone, etc.), etc.

The silver halide photographic material which is used for the image-forming process of this invention contains therein a hydrazine derivative. Preferred examples of the hydrazine derivative are arylhydrazides wherein a sulfinic acid residue is bonded to a hydrazo moiety as described in U.S. Pat. No. 4,478,928 and the compounds represented by the following general formula (I):

$$R_1\text{-}NHNH\text{-}G\text{-}R_2 \qquad (I)$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group.

The aliphatic group represented by $R_1$ in general formula (I) is preferably a straight chain, branched or cyclic alkyl group having 1 to 30 carbon atoms, particularly 1 to 20 carbon atoms. The branched alkyl group represented by $R_1$ may be cyclized to form a saturated heterocyclic ring containing at least 1 hetero atom therein. Also, the aforesaid alkyl group may have a substituent such as an aryl group, an alkoxy group, a sulfoxy group, a sulfonamido group, a carbonamido group, etc.

The aromatic group represented by $R_1$ in general formula (I) is preferably a monocyclic or bicyclic aryl group or an unsaturated heterocyclic ring group. In this case, the unsaturated heterocyclic ring group may condense with a monocyclic or bicyclic aryl group to form a heteroaryl group. Specific examples of the aromatic group represented by $R_1$ are a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc. In these rings, the rings containing a benzene ring are preferred.

The particularly preferred group represented by $R_1$ is an aryl group. The aryl group or the unsaturated heterocyclic ring group represented by $R_1$ may be substituted. Specific examples of the substituent are a straight chain, branched or cyclic alkyl group (preferably having 1 to 20 carbon atoms), an aralkyl group (preferably monocyclic or bicyclic aralkyl group having an alkyl moiety of 1 to 3 carbon atoms), an alkoxy group (preferably having 1 to 20 carbon atoms), a substituted amino group (preferably an amino group substituted by an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), etc.

The alkyl group represented by $R_2$ in general formula (I) is preferably an alkyl group having 1 to 4 carbon atoms and may have a substituent such as a halogen atom, a cyano group, a carboxy group, a sulfo group, an alkoxy group, a phenyl group, etc.

In the groups represented by $R_2$ in general formula (I), the aryl group which may be substituted is preferably a monocyclic or bicyclic aryl group, including, for example, a benzene ring. The aryl group may be substituted by, for example, a halogen atom, an alkyl group, a cyano group, a carboxy group, a sulfo group, etc.

In the groups represented by $R_2$ in general formula (I), the alkoxy group which may be substituted is preferably an alkoxy group having 1 to 8 carbon atoms and may be substituted by a halogen atom, an aryl group, etc.

Also, in the groups represented by $R_2$ in general formula (I), the aryloxy group which may be substituted is preferably a monocyclic aryloxy group and examples of the substituent are a halogen atom, etc.

When G is a carbonyl group, a preferred group represented by $R_2$ is a hydrogen atom, a methyl group, a methoxy group, an ethoxy group or a substituted or unsubstituted phenyl group and is particularly preferably a hydrogen atom.

When G is a sulfonyl group, $R_2$ is preferably a methyl group, an ethyl group, a phenyl group, or a 4-methylphenyl group and is particularly preferably a methyl group.

When G is a phosphoryl group, $R_2$ is preferably a methoxy group, an ethoxy group, a butoxy group, a phenoxy group, or a phenyl group and is particularly preferably a phenoxy group.

When G is a sulfoxy group, $R_2$ is preferably a cyanobenzyl group, a methylthiobenzyl group, etc., and when G is an N-substituted or unsubstituted iminomethylene group, $R_2$ is preferably a methyl group, an ethyl group or a substituted or unsubstituted phenyl group.

The group represented by $R_1$ or $R_2$ in general formula (I) may contain a ballast group which is usually used for immobile photographic additives such as couplers, etc. A ballast group is a group having at least 8 carbon atoms and relatively inactive to photographic properties and can be selected from an alkyl group, an alkoxy group, a phenyl group, an alkylphenyl group, a phenoxy group, an alkylphenoxy group, etc.

The group represented by $R_1$ or $R_2$ in general formula (I) may contain a group strengthening the adsorption for the surface of silver halide grains. As such an adsorptive group, there are a thiourea group, a heterocyclic thioamido group, a mercaptoheterocyclic ring group, a triazole group, etc., described in U.S. Pat. No. 4,385,108.

The most preferred group represented by G in general formula (I) is a carbonyl group.

Then, specific examples of the compounds represented by general formula (I) are illustrated below but the invention is not limited to these compounds.

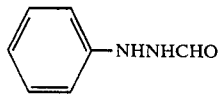

(I-1)

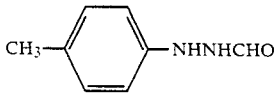

(I-2)

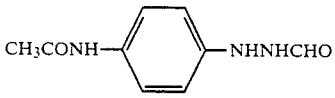

(I-3)

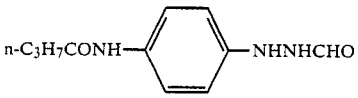

(I-4)

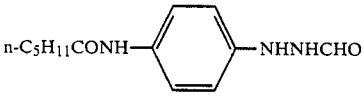

(I-5)

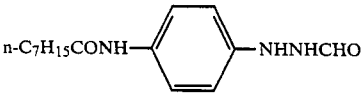

(I-6)

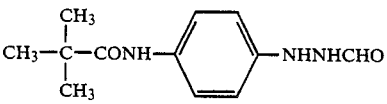

(I-7)

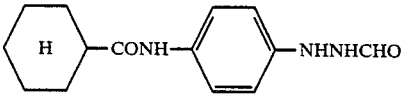

(I-8)

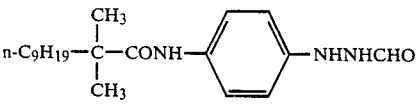

(I-9)

-continued
(I-10)
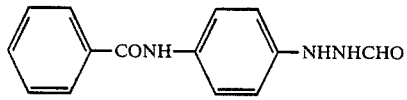
(I-11)
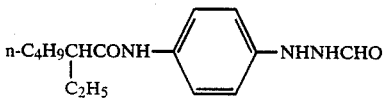
(I-12)
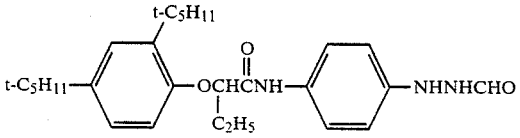
(I-13)
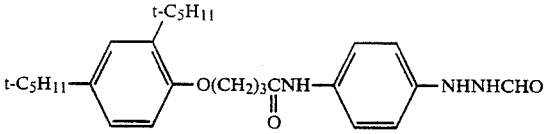
(I-14)
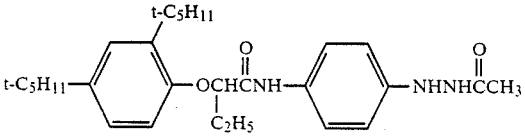
(I-15)
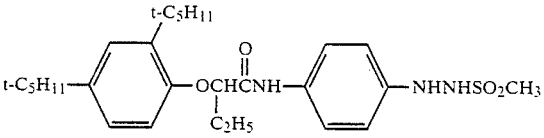
(I-16)
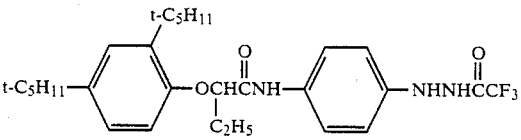
(I-17)
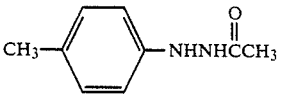
(I-18)
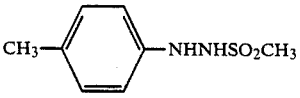
(I-19)
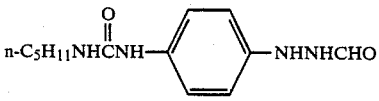
(I-20)
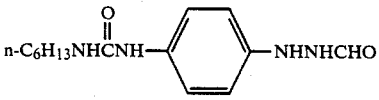
(I-21)
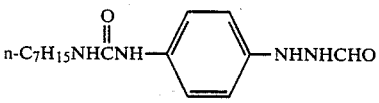

-continued (I-22)

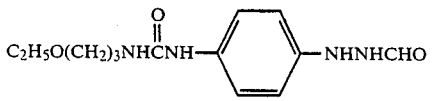

(I-23)

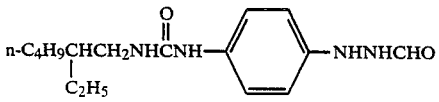

(I-24)

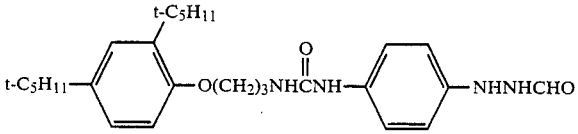

(I-25)

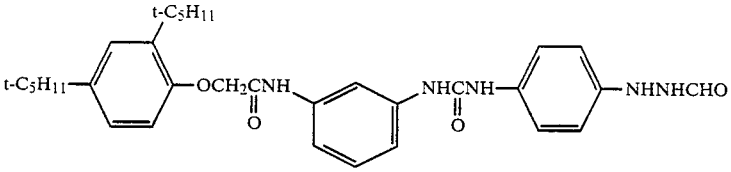

(I-26)

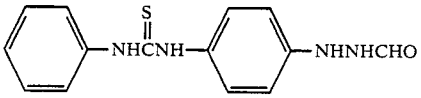

(I-27)

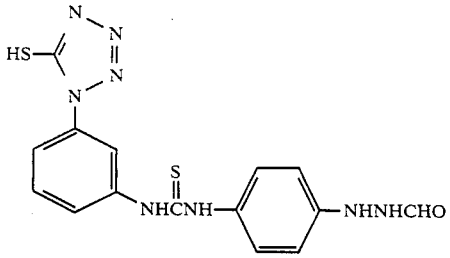

(I-28)

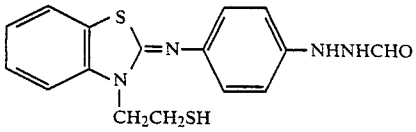

(I-29)

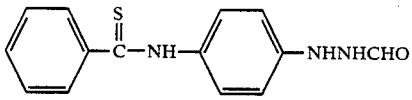

(I-30)

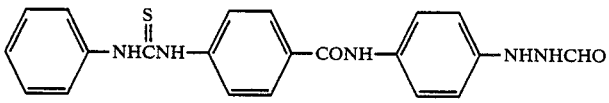

(I-31)

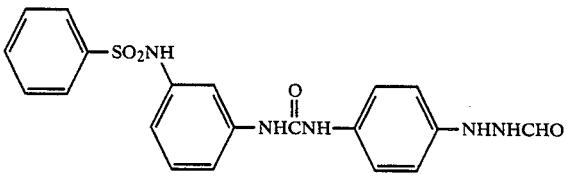

It is preferred that the content of the hydrazine derivative for use in this invention is $1\times10^{-6}$ to $5\times10^{-2}$ mol, particularly $1\times10^{-5}$ mol to $2\times10^{-2}$ mol, per mol of silver halide in the silver halide emulsion layer.

The hydrazine derivative for use in this invention is incorporated in a photographic light-sensitive material by the following manner. That is, when the hydrazine derivative is soluble in water, the hydrazine derivative may be added to a silver halide emulsion or a solution or an emulsion of hydrophilic colloid as an aqueous solution thereof and when the hydrazine derivative is insoluble in water, it may be added thereto as a solution thereof in an organic solvent miscible with water, such as an alcohol (e.g., methanol, ethanol, etc.), an ester (e.g., ethyl acetate, etc.), a ketone (e.g., acetone, etc.), etc.

There is no particular restriction on the silver halide which is used for light-sensitive silver halide emulsion layer(s) of the light-sensitive material of this invention and silver chloride, silver chlorobromide, silver chloroiodobromide, silver iodobromide, silver bromide, etc., can be used. In the case of using silver iodobromide or silver chloroiodobromide, however, it is preferred that the content of silver iodide is in the range of not more than 5 mol%.

There is also no restriction on the form, crystal habit, grain size distribution, etc., of the silver halide grains for use in this invention but silver halide grains having grain size of not more than 0.7 μm are preferred.

The sensitivity of the silver halide emulsion can be increased without increasing the size of the silver halide grains by using a gold compound such as a chloroaurate, gold trichloride, etc., a salt of a noble metal such as rhodium, iridium, etc., a sulfur compound forming silver sulfide by causing a reaction with a silver salt, or a reducing substance such as a stannous salt or an amine.

Furthermore, a salt of a noble metal such as rhodium, iridium or an iron compound such as potassium ferricyanide, etc., may exist at the physical ripening or nuclear formation of silver halide grains.

As the hydrophilic colloid binder which is used for a light-insensitive upper layer, silver halide emulsion layer(s) and other hydrophilic colloid layer(s) of the photographic light-sensitive material of this invention, gelatin is advantageously used but other hydrophilic colloids can be used.

Examples of such hydrophilic colloids are gelatin derivatives, graft polymers of gelatin and other polymers, proteins such as albumin, casein, etc., cellulose derivatives such as hydroxyethyl cellulose, carboxymethyl cellulose, cellulose sulfuric acid esters, etc., sugar derivatives such as sodium alginate, starch derivatives, etc., and synthetic hydrophilic polymers such as polyvinyl alcohol partial acetal, poly-N-vinylpyrrolidone, polyacrylic acid, polymethacrylic acid, polyacrylamide, polyvinyl imidazole, polyvinylpyrazole, etc.

As gelatin, lime-treated gelatin, acid-treated gelatin, and enzyme-treated gelatin as described in *Bull. Soc. Sci. Phot. Japan,* No. 16, page 30 (1966) may be used and, further, the hydrolyzed products or enzyme-decomposition products of gelatin can be also used in this invention.

The silver halide photographic emulsions for use in this invention may be spectrally sensitized by methine dyes, etc. Examples of the dyes which are used for the purpose are cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to cyanine dyes, merocyanine dyes and complex merocyanine dyes.

The sensitizing dyes may be used solely or as a combination thereof. The combination of sensitizing dyes is frequently used for the purpose of supersensitization.

Also, the silver halide emulsion may further contain a dye which does not have a spectral sensitizing action by itself or a material which does not substantially absorb visible light and shows supersensitizing action together with the sensitizing dye(s).

The photographic emulsions for use in this invention may contain various kinds of compounds for preventing the formation of fog during the production, the storage, or the photographic processing of the light sensitive materials of this invention or stabilizing the photographic properties of the light-sensitive materials. For example, there are many compounds known as antifoggants or stabilizers, such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyridines; mercaptotriazines; thioketo compounds (e.g., oxazolinethione); azaindenes (e.g., triazaindenes, tetraazaindenes (in particular, 4-hydroxy-substituted (1,3,3a,7)tetraazaindenes), pentaazaindenes, etc.); benzenethiosulfonic acid; benzenesulfinic acid; benzenesulfonic acid amide, etc.

In the above-described compounds, benzotriazoles (e.g., 5-methylbenzotriazole) and nitroindazoles (e.g., 5-nitroindazole) are particularly preferred. Also, these compounds may be incorporated in processing solutions.

The photographic light-sensitive materials of this invention may further contain inorganic or organic hardening agents in the photographic emulsion layers and other hydrophilic colloid layers. For example, there are chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They can be used solely or as a combination thereof.

Moreover, the light-sensitive materials of this invention may further contain in the photographic emulsion layers and other hydrophilic colloid layers various surface active agents for various purposes as coating aid, for static prevention, for improving sliding property, for improving dispersibility, for adhesion prevention, and for improving photographic properties (e.g., development acceleration, increase of contrast, increase of sensitivity, etc.).

Examples of the surface active agents are nonionic surface active agents such as saponin (steroid series), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents containing an acid group :containing a carboxy group, a sulfo group, a phospho group, a sulfuric acid ester group, a phosphoric acid ester group, etc., such as alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic or aromatic quaternary ammonium salts, heterocyclic quaternary ammonium salts such as pyridiniums, imidazoliums, etc., phosphonium salts or sulfonium salts containing an aliphatic ring or a heterocyclic ring, etc.

In the case of using polyalkylene oxides in this invention, it is preferred to use the polyalkylene oxides having a molecular weight of higher than 600 described in U.S. Pat. No. 4,221,857.

The photographic light-sensitive materials of this invention can further contain in the photographic emulsion layers and other hydrophilic colloid layers the dispersion of a water-insoluble or sparingly water-soluble synthetic polymer for improving the dimensional stability thereof, etc. Examples of the synthetic polymer are homopolymers or copolymers of an alkyl acrylate, an alkyl methacrylate, an alkoxyalkyl acrylate, an alkoxyalkyl methacrylate, a glycidyl acrylate, a glycidyl methacrylate, an acrylamide, a methacrylamide, a vinyl ester (e.g., vinyl acetate), an acrylonitrile, an olefin, a styrene, etc., solely or as a combination thereof, or as a combination of the above-described monomer and acrylic acid, methacrylic acid, $\alpha,\beta$-unsaturated dicarboxylic acid, hydroxyalkyl acrylate, hydroxyalkyl methacrylate, sulfoalkyl acrylate, sulfoalkyl methacrylate, styrenesulfonic acid, etc.

The above-described silver halide emulsions and various additives for use in this invention are described in detail in *Research Disclosure,* No. 176, Item 17643 (December, 1978).

For obtaining superhigh contrast photographic characteristics using the above-described silver halide photographic materials, a stable developer can be used without need of using a conventional infectious developer or the high alkali developer of about pH 13 described in U.S. Pat. No. 2,419,975.

That is, for processing the above-described silver halide photographic material, a developer containing a sufficient amount (in particular, not lower than 0.15 mol/liter) of sulfite ion as a preservative can be used and also negative images having a sufficiently superhigh contrast can be obtained using a developer of pH of not lower than 9.5, preferably 9.5 to 12.3, more preferably 10.5 to 12.3.

The above-described silver halide photographic material of this invention can provide superhigh contrast negative images having gamma of over 10 by a rapid development process (rapid access processing) of 15 to 60 seconds for the development time using the stable developer as described above and thus the photographic material of this invention is very useful.

There is no particular restriction on the developing agent for use in the process of this invention. Examples of the developing agent are dihydroxybenzenes (e.g., hydroquinone, etc.), 3-pyrazolidones (e.g., 1-phenyl-3-pyrazolidone, 4,4-dimethyl-1-phenyl-3-pyrazolidone, etc.), aminophenols (e.g., N-methyl-p-aminophenol, etc.), etc. They can be used solely or as a combination thereof.

The developer for use in this invention may further contain a pH buffer such as the sulfite, carbonate, borate, and phosphate of an alkali metal and a development inhibitor or an antifoggant such as a bromide, an iodide, and an organic antifoggant (particularly preferably nitroindazoles and benzotriazoles). Also, if necessary, the developers for use in this invention may further contain a hard water softener, a dissolution aid, a color toning agent, a development accelerator, a surface active agent (particularly preferably the above-described polyalkylene oxides), a defoaming agent, a hardening agent, a silver stain preventing agent for film (e.g., 2-mercaptobenzimidazole sulfonates), etc.

Practical examples cf these additives are described in *Research Disclosure,* No. 176, 17643 (December, 1978), etc.

The processing temperature is usually selected in the range of 18° C. to 50° C. but may be lower than 18° C. or higher than 50° C.

A fixing solution having an ordinary composition can be used in this invention. As the fixing agent, thiosulfates, thiocyanates, etc., as well as organic sulfur compounds which are known to have an effect as a fixing agent can be used. The fixing solution may contain a water-soluble aluminum salt as a hardening agent.

For the photographic processing in this invention, it is preferred to use an automatic developing machine.

BEST MODE FOR CARRYING OUT THE INVENTION

Then, the invention is explained in more detail by referring to the following examples.

EXAMPLE 1

By repeating the formation of silver halide grains using a controlled double jet method, three kinds of monodispersed negative type Silver Halide Emulsions A, B and C shown in Table 1 below were prepared. In addition, by changing the charging temperature, Emulsions A, B and C were prepared so that the mean grain size became 0.25 $\mu$m. Each of the emulsions was washed by an ordinary manner to remove soluble salts and then 4-hydroxy-6-methyl-1,3,3a,7-tetraazaindene was added thereto as a stabilizer.

Each of the three kinds of silver halide emulsions was split into five portions and then Compound (I-12) and Compound (A-1), (A-2), (A-7) or (A-9) in this invention were added to each portion of the split emulsion as shown in Table 1 below. Then, after adding 3-ethyl-5-[2-(3-ethyl-2(3H)thiazolinidene-ethylidene]rhodanine as a sensitizing dye, and further 5-methylbenzotriazole, a dispersion of polyethyl acrylate, and 2-hydroxy-4,6-dichloro-1,3,5-triazine sodium salt to each emulsion, the resultant emulsion was coated on a polyethylene terephthalate film at a silver coverage of 4 g/m$^2$.

Each of the sample films thus prepared was exposed through a sensitometric exposure wedge using a magenta contact screen of 150 lines, developed by the developer having the composition described below for 20 seconds at 38° C., stopped, fixed, washed, and dried. About each sample thus processed, gamma ($\gamma$) was measured and the dot quality of the image was evaluated. The results are shown in Table 1 below.

| Developer: | |
|---|---|
| Sodium Sulfite | 75 g |
| Sodium Hydrogencarbonate | 7.0 g |
| Hydroquinone | 40 g |
| 1-Phenyl-4,4-dimethyl-3-pyrazolidone | 0.4 g |
| Sodium Bromide | 3.0 g |
| 5-Methylbenzotriazole | 0.8 g |
| Ethylenediaminetetraacetic Acid Disodium Salt | 1.0 g |
| Water to make | 1 liter |
| pH adjusted to 11.5 with porassium hydroxide | |

soluble salts and then 4-hydroxy-6-methyl-1,3,3a,7-tetraazaindene was added thereto as a stabilizer.

Emulsion D was split into five portions and Compound (I-20) and Compound (A-1), (A-2), (A-7) or (A-9) of this invention were added to each split portion of the silver halide emulsion as shown in Table 2 below. Then, a dispersion of polyethyl acrylate and 2-hydroxy4,6-dichloro-1,3,5-triazine sodium salt were added to each emulsion and the resultant emulsion was coated on a polyethylene terephthalate film at a silver coverage of 3.5 g/m$^2$.

Each of the sample films was exposed through a sensitometric exposure wedge using P-607 Type Printer, made by Dainippon Screen Mfg. Co., Ltd., developed by the developer having the composition shown below for 20 seconds at 38° C., stopped, fixed, washed and dried. The gamma and the letter image quality were evaluated and the results are shown in Table 2.

TABLE 1

| Sample | Emulsion | | Compound (I) | | Compound (A) | | | Dot |
|---|---|---|---|---|---|---|---|---|
| No. | Kind | Halogen Composition | Kind | Amount* | Kind | Amount* | Gamma** | Quality*** |
| 1 | A | AgBrI (I = 1 mol %) | (I-12) | $2.5 \times 10^{-3}$ | — | — | 4 | 1 |
| 2 | " | " | " | " | (A-1) | $1 \times 10^{-3}$ | 18 | 5 |
| 3 | " | " | " | " | (A-2) | " | 12 | 4 |
| 4 | " | " | " | " | (A-7) | " | 16 | 5 |
| 5 | " | " | " | " | (A-9) | " | 17 | 5 |
| 6 | B | AgBr | " | " | — | — | 4 | 1 |
| 7 | " | " | " | " | (A-1) | $1 \times 10^{-3}$ | 15 | 5 |
| 8 | " | " | " | " | (A-2) | " | 11 | 4 |
| 9 | " | " | " | " | (A-7) | " | 13 | 4 |
| 10 | " | " | " | " | (A-9) | " | 15 | 5 |
| 11 | C | AgBrCl (Br = 50 mol %) | " | " | — | — | 8 | 2 |
| 12 | " | " | " | " | (A-1) | $1 \times 10^{-3}$ | 25 | 5 |
| 13 | " | " | " | " | (A-2) | " | 16 | 5 |
| 14 | " | " | " | " | (A-7) | " | 18 | 5 |
| 15 | " | " | " | " | (A-9) | " | 20 | 5 |

In Table 1:

*The unit of the addition amount is mol/mol-Ag.

**Gamma (γ) is shown by the following value:

$$\text{Gamma } (\gamma) = \frac{(3.0 - 0.3)}{\log(E_{3.0}) - \log(E_{0.3})}$$

$E_{3.0}$: The exposure amount of giving density of 3.0

$E_{0.3}$: The exposure amount of giving density of 0.3

***The dot quality is visually evaluated in the following five ranks, wherein rank 5 is the best quality and rank 1 the worst quality. Ranks 5 and 4 are practically usable, rank 3 is barely usable although the quality is not so good, and ranks 2 and 1 are dot images which are unsuitable for practical use.

From the results shown in Table 1, it can be seen that in the case of using the hydrazine derivative and the compound of general formula (A) together, a very high contrast of not lower than 10 in gamma is obtained and the dot quality of images is very excellent.

Furthermore, these excellent effects of this invention are obtained in a wide range of halogen compositions of the silver halide emulsions.

EXAMPLE 2

By performing the formation of silver halide grains in the existence cf rhodium ammonium chloride, a monodispersed negative type Silver Chlorobromide Emulsion D (bromine content: 30 mol%) (having mean grain size of 0.20 um) containing the rhodium salt of $5.0 \times 10^{-5}$ mol/mol-Ag was prepared.

The silver halide emulsion thus prepared was washed with water according to an ordinary manner to remove

| Developer: | |
|---|---|
| Ethylenediaminetetraacetic Acid Tetrasodium Salt | 1.0 g |
| Sodium Hydroxide | 13.0 g |
| Potassium Tertiary Phosphate | 74.0 g |
| Potassium Sulfite | 90.0 g |
| 3-Diethylamino-1-propanol | 15.0 g |
| N-Methyl-p-aminophenol.½Sulfate | 0.8. g |
| Hydroquinone | 35.0 g |
| 5-Methylbenzotriazole | 0.5 g |
| Sodium Bromide | 3.0 g |
| Water to make | 1 liter |
| | pH = 11.6 |

TABLE 2

| Sample | Emulsion | | Compound (I) | | Compound (A) | | | Letter Image |
|---|---|---|---|---|---|---|---|---|
| No. | Kind | Rh Content*1 | Kind | Amount*2 | Kind | Amount*2 | Gamma** | Quality*** |
| 16 | D | $5 \times 10^{-5}$ | (I-20) | $2.5 \times 10^{-3}$ | — | — | 10 | 2 |
| 17 | " | " | " | " | (A-1) | $5 \times 10^{-3}$ | 23 | 5 |
| 18 | " | " | " | " | (A-2) | " | 18 | 4 |
| 19 | " | " | " | " | (A-7) | " | 20 | 5 |

TABLE 2-continued

| Sample No. | Emulsion Kind | Emulsion Rh Content*1 | Compound (I) Kind | Compound (I) Amount*2 | Compound (A) Kind | Compound (A) Amount*2 | Gamma** | Letter Image Quality*** |
|---|---|---|---|---|---|---|---|---|
| 20 | " | " | " | " | (A-9) | " | 19 | 5 |

*1,*2The units of the Rh content and the addition amount are mol/mol-Ag.
**Gamma value is the same as defined in Table 1 of Example 1.
***The letter image quality is as described in Japanese Patent Application (OPI) No. 190943/83 (the term "OPI" as used herein refers to a "published unexamined Japanese patent application"), a laminate film composed of base film/line positive image-having film (line image original)/base film/dot image-having film (dot original) is closely superposed on each film sample so that the protective layer and the dot original is in a face-to-face relationship, an aptitude exposure is applied so that 50% of the dot area becomes 50% of the dot area on the film sample, and then the sample is processed as above. In this case, a sample capable of reproducing the letter of 30 μm in width of the line original is rank 5, a sample capable of reproducing a letter of 150 μm width only is rank 1, and ranks 4, 3 and 2 are functionally evaluated between ranks 5 and 1. Rank 2 is the lowest practically usable rank.

From the results shown in Table 2, it can be seen that in the case of using the hydrazine derivative and the compound of general formula (A) together, a greatly high contrast is obtained for the silver halide emulsion containing a large amount of rhodium (Rh) and also the letter image quality of the light-sensitive material is excellent.

On the other hand, in Comparison Sample No. 16 not containing the compound of general formula (A) of this invention, the gamma may be high as 10 but the letter image quality of the light-sensitive material is insufficient.

INDUSTRIAL APPLICABILITY

As described above, when a photographic light-sensitive material is processed by a developer containing the compound of this invention shown by general formula (A) described above or a processing solution for the prebath thereof containing the compound of formula (A), or when a photographic light-sensitive material containing the compound of general formula (A) in the silver halide emulsion layer or other hydrophilic colloid layer thereof is developed, high contrast negative images of over 10 in gamma which are useful for a photomechanical process can be formed quickly (at a development time of 15 to 60 seconds) using a stable developer containing a sufficient amount of sulfite ion (in particular, more than 0.15 mol/liter).

We claim:

1. A high contrast negative image-forming process which comprises image-wise exposing and subsequently developing a silver halide photographic material having on a support at least one silver halide emulsion layer, said silver halide emulsion layer or at least one other hydrophilic colloid layer containing a high contrast imparting hydrazine derivative represented by general formula (I)

$$R_1—NHNH—G—R_2 \quad (I)$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group, and said development occurring in the presence of a compound represented by the following general formula (A):

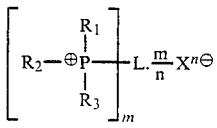

(A)

wherein $R_1$, $R_2$ and $R_3$ each represent an alkyl group, a cycloalkyl group, an aryl group, an alkenyl group, a cycloalkenyl group, or a heterocyclic ring residue; these groups each may have a substituent; m represents an interger; L represents an m-valent organic group bonded to the P atom through a carbon atom; n represents an integer of 1 to 3; X represents an n-valent anion; said X may be bonded to L; and wherein development time is from 15 to 60 seconds.

2. The high contrast negative image-forming process as claimed in claim 1, wherein a developer which is used for the development contains at least 0.15 mol/liter of a sulfite and has a pH of 9.5 to 12.3.

3. The high contrast negative image-forming process as claimed in claim 1, wherein in the compound shown by general formula (A), m is 1, 2 or 3 and $R_1$, $R_2$ and $R_3$ are a substituted or unsubstituted alkyl group having at most 20 total carbon atoms or a substituted or unsubstituted aryl group having at most 30 total carbon atoms.

4. The high contrast negative image-forming process as claimed in claim 1, wherein the compound of general formula (A) exists in the silver halide emulsion layer or at least one other hydrophilic colloid layer of the silver halide photographic material.

5. The high contrast negative image-forming process as claimed in claim 4, wherein the compound of general formula (A) exists in an amount of $1\times10^{-5}$ to $1\times10^{-2}$ mol per mol of the silver halide in the silver halide emulsion layer.

6. The high contrast negative image-forming process as claimed in claim 1, wherein the processing time from initiation of development to the obtainment of the processed film is from 90–120 seconds.

* * * * *